United States Patent [19]

Bourrelly et al.

[11] Patent Number: 4,658,251

[45] Date of Patent: Apr. 14, 1987

[54] HEAT SEAL MONITORING DEVICES FOR A CONTAINER, WHICH MORE PARTICULARLY CONTAINS CALOGENIC MATERIAL

[75] Inventors: Paul Bourrelly, Marseilles; Jean Monier, Bourg la Reine; Henri Patin, Marseilles; Charles Sanson, Chatenay Malabry; Robert Schoepp, Marseilles, all of France

[73] Assignee: Commissariat a l'Energie Atomique, France

[21] Appl. No.: 756,773

[22] Filed: Jul. 18, 1985

[30] Foreign Application Priority Data

Jul. 24, 1984 [FR] France ..... 84 11721

[51] Int. Cl.[4] ..... G08B 21/00

[52] U.S. Cl. ..... 340/820.17; 340/590

[58] Field of Search ..... 340/870.17, 595, 550, 340/572, 541, 590; 374/4, 43, 44, 185, 210, 5

[56] References Cited

U.S. PATENT DOCUMENTS 3,375,702 4/1968 Birman ..... 340/595 X

OTHER PUBLICATIONS

Green, D. R. Thermal and Infrared . . . Ceramics, Materials Evaluation, vol. 29, No. 11, Nov. 71, pp. 241-247.

*Primary Examiner*—Jerry W. Myracle

*Attorney, Agent, or Firm*—Cesari and McKenna

[57] ABSTRACT

A heat seal monitoring device for a container, such as one containing a calogenic material, includes one or more seals, placed on a container surface element and having a plurality of electrically interconnected resistive components enclosed in a structure having a first material acting as a physical protection and a second material acting as a thermal insulation. Each initial cap seal is able to supply an electric signal representing the heat flux exchanged between the surface element and the seal.

11 Claims, 9 Drawing Figures

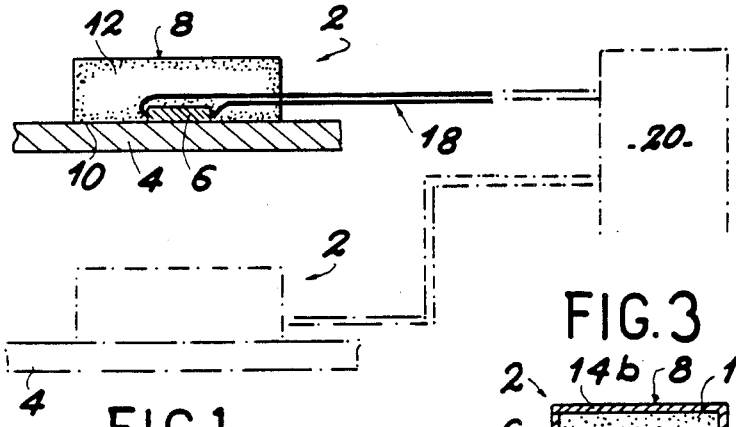
FIG.1
FIG.3
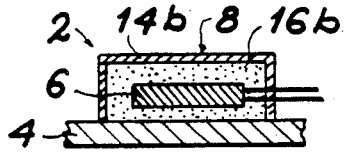
FIG.2
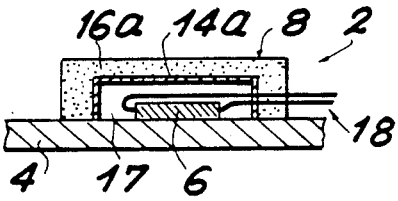
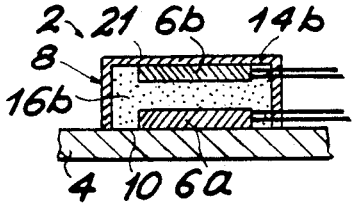
FIG.4
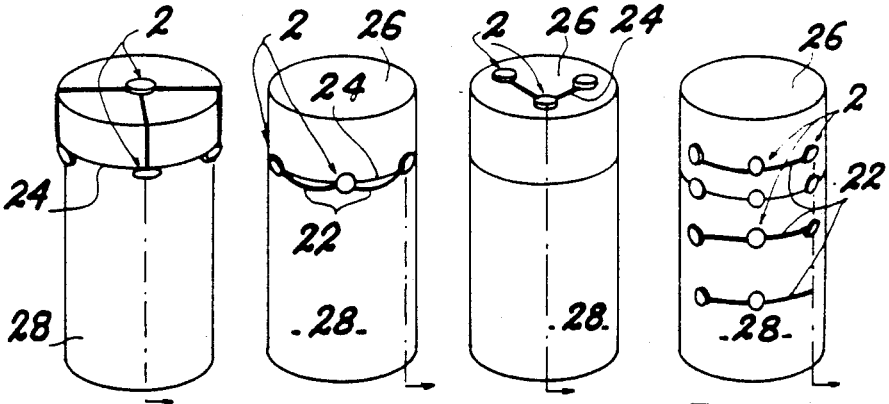
FIG.6 FIG.7 FIG.8 FIG.9

HEAT SEAL MONITORING DEVICES FOR A CONTAINER, WHICH MORE PARTICULARLY CONTAINS CALOGENIC MATERIAL

BACKGROUND OF THE INVENTION

The present invention relates to heat seal monitoring devices of a container, which more particularly contains calogenic material making it possible to detect an attempt at a forced entry burglary with respect to the container and/or the material contained therein, or a theft, even in the case where the thief succeeds in refitting the monitoring device.

It more particularly applies to the monitoring of a large number of fixed or mobile container, e.g. 400 to 500 containers, containing radioactive calogenic material, no matter what the thermal environment of said container. In this case, the container containing the calogenic material has parts which, as a result of heat exchanges, have different temperatures to the ambient temperature.

At present, there are a certain number of monitoring devices making it possible to detect the attempted opening of a container. One of these devices involves fixing the ends of a cable passing through the knuckle joint or closing scoops or louvers of a container to a box, in which has been poured a resin material, which has cracked on cooling. These cracks form a clearly defined design, which is photographed at the outset. When somebody attempts to open and then re-seal the box, the resin material contained therein can move and/or new cracks can appear. These changes can be observed by photographing the resin again.

However, detection is not possible in the case where the thief does not touch the box and takes the precaution of only cutting the cable, which is then joined together again by splicing. Moreover, as the monitoring of such a device requires a physical presence, it does not permit a continuous monitoring of the containers. Moreover, in the case of radioactive materials, this device involves an undesirable exposure of the monitoring personnel to the radiation emitted by said materials.

Monitoring devices are also known which permit a continuous or real time monitoring, like those described in EP-A-0018 198. These devices use optical seals, which do not make it possible to make a distinction between calogenic and non-calogenic materials. Moreover, they do not make it possible to detect an intrusion into the container when the seals are left intact.

The present invention relates to burglar-proof monitoring devices for a container, which more particularly contains a calogenic material, making it possible to obviate the aforementioned disadvantages and which make it possible to detect any attempted burglary and/or theft, no matter the location at which this takes place. It is based on the fact that any modification to the container or its content disturbs the thermal state of the container surface to which the sealing device is fixed. Container is understood to mean any sealed enclosure and particularly a member.

The use of heat sensors associated with a data acquisition system is known and in particular is described in the article by H. DUANE ARLOWE, Nuclear Materials Management, 1982, pp. 82 to 88, entitled "A low cost SNM shelf monitor system", relative to the detection of the presence of a container on a shelf and the checking of its calogenic content. However, the latter device permits qualitative rather than quantitative measurements and also does not constitute a sealing device.

SUMMARY OF THE INVENTION

The present invention relates to a device for monitoring a container, which more particulary contains calogenic material, used for checking the presence and integrity of the container, characterised in that it comprises at least one seal, placed on a surface element of the container and having at least one resistive component enclosed in a structure used for physical protection and thermal insulation purposes, said seal being able to supply an electric signal representing the heat flux exchanged between the surface element and said seal and/or the heat flux exhanged between the seal environment and the actual seal, as well as monitoring means sensitive to said signal and positioned at a distance from the container.

The use of a seal supplying an electric signal representing the heat flux exchanged with the surface element on which it is placed and/or the heat flux exchanged with its environment, makes it possible to detect any variation of said heat flux on the basis of a modification of the electric signal emitted by the seal. The heat flux variations can be due to a modification in the environment of the sealed container (displacement of the latter or adjacent container), to a modification of the seal geometry (change, displacement of the latter), to a modification of the in particular calogenic content and to the presence or intervention of a random means (person, robot) on a random part of the container.

According to a preferred embodiment of the sealing device according to the invention, the structure of the seal or in other words its envelope is constituted by a single material used both for the physical protection and thermal insulation.

According to another preferred embodiment of the sealing device according to the invention, said structure is made from two different materials, one being used for the physical protection and the other for the thermal insulation.

According to another preferred embodiment of the device according to the invention, the seal has two independent series of electrically interconnected resistive components, one of the series being used to take account of the variations of the thermal flux exchanged between the seal and the surface of the container on which it is placed, while the other series is used for taking account of the variations of the heat flux exchanged the seal and its environment.

Advantageously, one the series of resistive components of the seal is placed either in the vicinity of the face of the seal which is applied to the container surface element, or directly in contact with said surface element on which the seal is placed. This arrangement makes it possible to bring about optimum sensing of the variation of the heat flux level with the surface element on which the seal is placed. The variation can be caused by a modification of the environment, the geometry of the seal or the possibly calogenic content.

In a preferred manner, the device according to the invention comprises several seals supplying different electrical signals, said signals being a function of the heat flux exchanged between the surface element and the corresponding attached seal, as well as the electrical characteristics of the resistive components constituting each seal.

Apart from the advantages give hereinbefore, the monitoring device according to the invention makes it possible to monitor the container content in the case of a container containing calogenic material.

BRIEF DESCRIPTION OF THE DRAWINGS

The invention is described in greater detail hereinafter relative to non-limitative embodiments and the attached drawings, wherein show:

FIG. 1 diagramatically a monitoring device according to the invention having heat seals according to a first embodiment.

FIG. 2 diagramatically a heat seal according to the invention in the case of a second embodiment, in which the thermal insulating material is on the outside.

FIG. 3 diagramatically a heat seal according to the second embodiment of the invention, in which the physical protection material is on the outside.

FIG. 4 diagramatically a heat seal according to a third embodiment of the invention.

FIGS. 6 to 9 different examples of fixing the heat seals according to the invention to a container to be monitored.

DETAILED DESCRIPTION OF THE PREFERRED EMBODIMENTS

Figure 5:
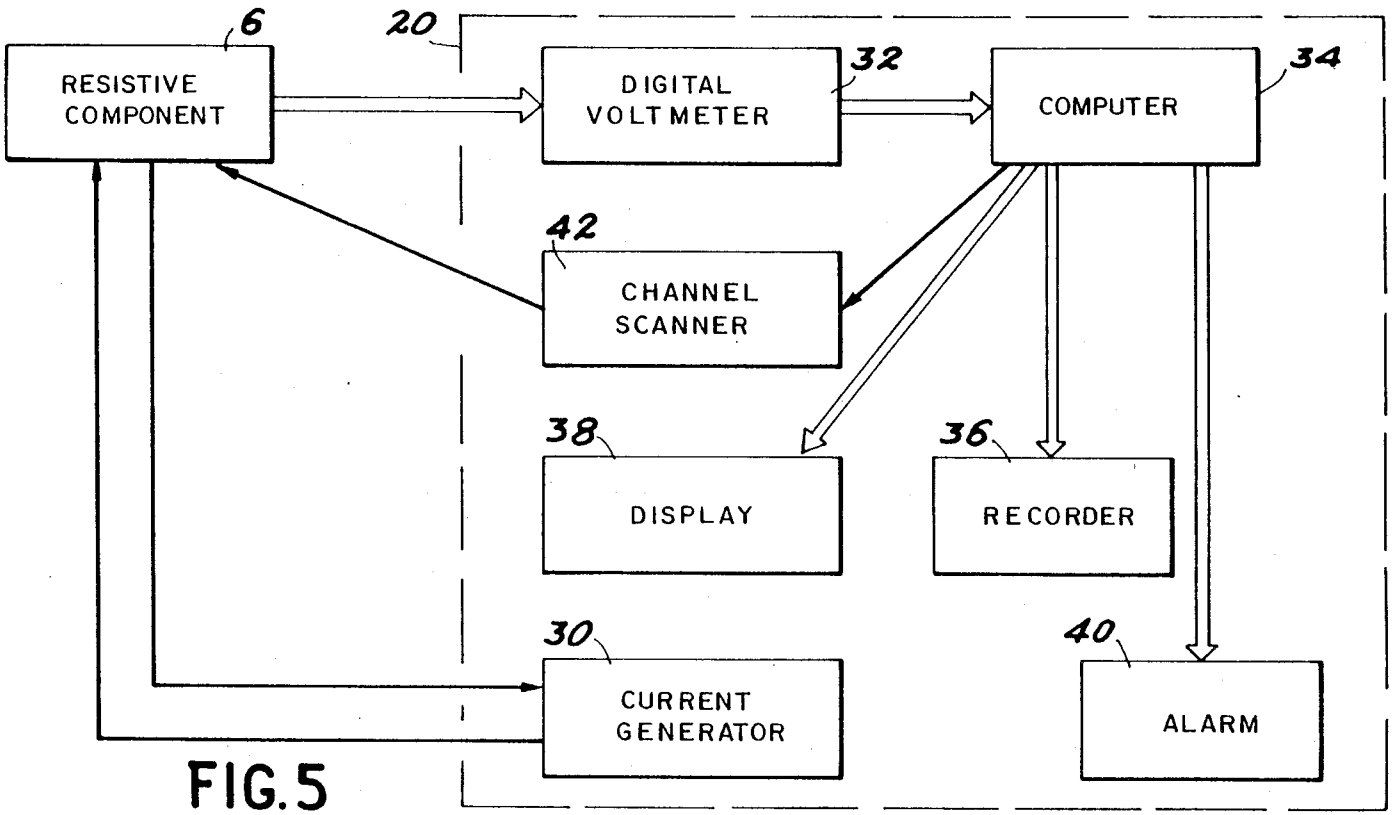
FIG. 5 diagramatically an embodiment of the electronic circuit of the monitoring device according to the invention.

FIG. 1 shows a monitoring device according to the invention comprising one or more seals 2 placed on a surface element 4 of a container, which more particularly contains calogenic material, e.g. constituted by irradiated or non-irradiated materials, or radioactive waste. Each seal is a heat fluxmeter supplying an electric signal representing the heat flux exchanged between it and the surface element 4 on which it is placed. It comprises one or more resistive element or components, which are connected to one another in series and/or in parallel and contained in an envelope or structure 8 serving as a physical protection and thermal insulation, said components being supplied with a direct or alternating current.

The resistive components 6 can be resistors having a positive or negative coefficient. Advantageously, they are positioned as close as possible to the face 10 of seal 2, which is applied to the surface element 4 of the container to be monitored (FIG. 3). In particular, these components can be arranged in such a way that they are in direct contact with the surface to be monitored, as shown in FIG. 1.

Structure 8 serving as a physical protection and thermal insulation can be constituted by a single material 12, which simultaneously fulfils the physical protection and thermal insulation functions. For example, this material can be an insulant, such as an epoxy resin. In this case, seal 2 can be fixed to the container surface element 4 by adhesion.

In the manner shown in FIGS. 2 and 3, structure 8 of seal 2 can be made from two different materials, one serving as a physical protection and the other as a thermal insulation.

In FIG. 2, the material acting as the physical protection carries reference 14*a* and that acting as the thermal insulation reference 16*a*. Material 14*a* can be e.g. formed by a metallic and in particular stainless steel cover, while material 16*a* is polyurethane foam.

In the variant shown in FIG. 2, material 14*a* acting as the physical protection (metal cover) is arranged in such a way as to envelop the resistive components 6, material 16*a* acting as the thermal insulant covering material 14*a*. An air void 17 can be provided between material 14*a* and resistive components 6, particularly when material 14*a* is metallic. In this variant, seal 2 can be fixed to the container surface element 4 by adhesion. In addition, resistive components 6 can be placed in direct contact with the surface element 4 of the container to be monitored.

In FIG. 3, the material serving as the physical protection carries the reference 14*b* and the material acting as the thermal insulant reference 16*b*. For example, material 14*b* can be constituted by a metal cover, particularly of stainless steel, while material 16*b* can be polyurethane foam or a gas, such as air.

In variant of FIG. 3, the resistive components 6 are completely embedded in the thermally insulating material 16*b*, the latter being covered by protective material 14*b*. They are not in contact with the container surface element 4 to be monitored and are instead located in the vicinity thereof. In this case, seal 2 can be fixed to container surface element 4 by adhesion, welding, brazing, etc.

The attachment of a seal 2, as shown in FIGS. 1 to 3, to a container surface element 4 automatically leads to the appearance of a natural thermal gradient of the surface element to which it is attached. The seal then emits an electric signal representing the heat flux exchanged between the surface element 4 and itself. This electric signal is a function of the exchanged heat flux and the electrical characteristics of the resistive components 6 forming the seal.

In the case of a container containing non-calogenic material, the resistive components 6 of a seal are supplied by a current adequate for bringing about a self-heating of these detectable components, the seal being said to be active.

The electric signal carried by a cable 18, as shown in FIG. 1, can be detected and then analyzed with the aid of an appropriate electronic circuit 20, to be described hereinafter and positioned at a distance from the container to be monitored.

FIG. 4 shows another embodiment of a heat seal according to the invention, which is said to be quantitative. In this embodiment, seal 2 has two independent series or rows 6*a* 6*b* of resistive components enclosed in structure 8. In each series, the electrical components are electrically interconnected. One of the series 6*a* is positioned, as hereinbefore, either in the vicinity of face 10 of seal 2, which is applied to the container surface element 4 (FIG. 3), or in direct contact with the surface to be monitored. As hereinbefore, it makes it possible to supply an electric signal representing the heat flux exchanged between seal 2 and the container surface element 4 to which the seal is to be attached.

The other series 6*b* is positioned in the vicinity of face 21 of seal 2 opposite to face 10 thereof. It makes it possible to supply an electric signal representing the heat flux exchanged between the environment of the seal and the actual seal.

In this embodiment, it is preferable from a practical standpoint for the structure 8 of seal 2 to be constituted by two different materials, material 14*b* acting as the physical protection being located towards the outside of the seal, while material 16*b* acting as the thermal insulant is enclosed in material 14*b*.

In the case of a container containing calogenic material, it is possible to use a system equivalent to the seal of FIG. 4, consisting of two seals as shown in FIGS. 1 to 3. One of the seals, called the first seal, supplies an electric signal representing the heat flux exchanged between itself and the surface of the container on which it is placed, while the second seal supplies an electric signal representing the heat flux exchanged between itself and its environment. In this arrangement, the first seal is placed on a tight surface of the container and the second seal is particulary placed on an ambient temperature portion of said container.

According to the invention, the same seal 2 can be used "quantitatively" for a container containing calogenic material and then "actively" when said material stops giving off heat. In other words, the same seal can be used in two different ways, depending on whether or not the container content is calogenic.

In the case of using calibrated resistive components 6, seals 2 constitute heat flux meters suitable for use in quantitative following and management by means of an appropriate circuit 20 of calogenic materials contained in the container to be monitored.

If the calogenic material to be monitored is well characterised, the measurement of the heat flux gives information on the material quantity present. In the opposite case, the measurement of the heat flux and the material quantity present are only correlated.

The use of resistive components with unknown electrical characteristics and which have been taken at random during the formation of seals 2, makes it possible to obtain seals having random electrical characteristics. An automatic tracking or following of the signal emitted by each random seal 2 by means of an electronic circuit 20 ensures that these characteristics remain completely unknown, even for the monitoring personnel and can consequently not be duplicated.

Moreover, the use of an appropriate circuit 20 permitting the acquisition and management of electric signals transmitted by seals 2 makes it possible to obtain a burglar-proof security device. In particular, circuit 20 making it possible to interrogate each seal 2 in a continuous manner, e.g. every millisecond, does not give long enough for a malevolent intervention to take place. Moreover, the acquisition and analysis system 20 can be such that it makes it possible to retain the outline of any intervention, particularly a malevolent intervention, on the containers to be monitored.

The circuit of FIG. 5 can in particular be used as the electronic circuit 20 for the detection of electric signals supplied by the heat seal or seals. This circuit 20 essentially comprises:

- a current-stabilized current generator 30 for supplying the resistive components 6;
- a digital voltmeter 32 recording analog electrical signals supplied by components 6 and converting them into digital data;
- a computer processing the signals from the voltmeter, such as the comparison of signals supplied by seals attached to the same container;
- recording means 36 (on a magnetic or paper support) of the results controlled by the computer 34;
- means 38 for displaying the same results and also controlled by computer 34;
- a possible alarm 40, once again controlled by the computer and emitting a light or sound signal in the case of a sudden modification to the electrical signals supplied by the heat seals, said alarm possibly being in the vicinity of the computer and/or display and recording means, or can be remote therefrom (several kilometers).

In order to permit a continuous interrogation of a large number of seals 2, a channel scanner 42 connected to the resistive components 6 and to the computer must be provided.

FIGS. 6 to 9 show differnt types of arrangements of seals according to the invention. These arrangements are formed from several seals 2 and can be mechanically interconnected, e.g. with the air of metal wires 22 (steel). These seals 2 can e.g. be attached, as shown in FIGS. 6 to 8, to the contact area 24 between the container cover 26 and the container body 28 or, as shown in FIG. 7, can be attached in the vicinity of said contact zone 24, e.g. on cover 26 or on the actual container body 28.

In the case of a container containing calogenic radioactive material, the seals are advantageously located out of the contact area 24 of the container and the container body (FIG. 7), so that for operational reasons, it is possible to open and then re-close the container, the seals detecting said intervention and the possible modification of the container content without being destroyed.

In the case of a container containing non-calogenic material, it is preferable to use a large number of seals, as shown in FIG. 8, so as to detect any instrusion (e.g. introduction of a tool) into the container, said seals being advantageously placed on the contact zone of the cover and the container body. Obviously these different seal arrangements are only given in an exemplified manner.

What is claimed is:

1. A device for monitoring a container to check the presence and integrity of the container contents, said device comprising at least one seal for placement on a container surface element, each seal including at least one thermally responsive resistive component and a structure protectively enclosing and thermally insulating said at least one resistive component on said surface element, each seal being able to supply an electric indication from its said at least one resistive component representing the heat flux exchanged between the surface element and said seal and monitoring means spaced at a distance from said seal and responsive to said electrical indication supplied therefrom.

2. A monitoring device according to claim 1, wherein at least one seal has a first series of electrically interconnected resistive components and supplies an electric indication from said first series to the monitoring means representing the heat flux exchanged between the surface element and said seal, and said seal also includes a second independent series of interconnected, thermally responsive resistive components inside said structure for supplying an electric indication to the monitoring means representing the heat flux exchanged between the environment of the seal and said seal.

3. A monitoring device according to claim 1, wherein at least one seal also includes a second, independent, thermally responsive resistive component inside said structure for supplying an electric indication to the monitoring means representing the heat flux exchanged between the environment of the seal and said seal.

4. A monitoring device according to any one of the claims 1 to 3, wherein the structure is constituted by a single material acting both as the physical protection and as the thermal insulation.

5. A monitoring device according to any one of the claims 1 to 3, wherein the structure is made from two different materials, one acting as the physical protection and the other as the thermal insulation.

6. A monitoring device according to any one of the claims 2 or 3 wherein said first series of resistive components is positioned in the vicinity of the face of the seal applied to the container surface element.

7. A monitoring device according to any one of the claims 2 or 3, wherein said first series of resistive components is placed in direct contact with the surface element on which the seal is placed.

8. A monitoring device according to any one of the claims 1 to 3 wherein a resistive component responsive to heat flux from the surface element is calibrated and is able to aid the quantitative management of the container contents.

9. A monitoring device according to any one of the claims 1 to 3 wherein a resistive component responsive to heat flux from the surface element is taken at random, so that its electricl characteristics are unknown.

10. A monitoring device according to any one of the claims 1 to 3 wherein it comprises several seals for placement on different surface elements of the same container and supplying differnt electric indications to said monitor.

11. A device for monitoring a container to check the presence and integrity of the container contents, said device comprising at least one seal for placement on a container surface element, each seal including at least one thermally responsive resistive component and a structure protectively enclosing and thermally insulating said at least one resistive component on said surface element, said seal being able to supply an electric indication from its said at least one resistive component representing the heat flux exchanged between the environment of said seal and said seal, and monitoring means spaced at a distance from said seal and responsive to said electrical indication supplied therefrom.

* * * * *